US006000327A

United States Patent [19]

Moriyasu et al.

[11] Patent Number: 6,000,327

[45] Date of Patent: Dec. 14, 1999

[54] WORK CONVEYOR OF TRANSFER PRESS

[75] Inventors: Takashi Moriyasu; Kenji Nishida; Shigekazu Noda; Kiichirou Kawamoto, all of Ishikawa-ken, Japan

[73] Assignee: Komatsu Ltd., Tokyo, Japan

[21] Appl. No.: 09/066,446

[22] PCT Filed: Nov. 1, 1996

[86] PCT No.: PCT/JP96/03217

§ 371 Date: Apr. 30, 1998

§ 102(e) Date: Apr. 30, 1998

[87] PCT Pub. No.: WO97/16268

PCT Pub. Date: May 9, 1997

[30] Foreign Application Priority Data

Nov. 2, 1995 [JP] Japan ..... 7-285688
Nov. 2, 1995 [JP] Japan ..... 7-285741

[51] Int. Cl.[6] ..... B30B 15/30; B21D 43/05

[52] U.S. Cl. ..... 100/207; 72/405.1; 198/621.1; 414/752

[58] Field of Search ..... 100/207, 208, 100/215; 72/405.09, 405.1, 422; 198/621.1, 621.3; 414/751, 752

[56] References Cited

U.S. PATENT DOCUMENTS

| | | | |
|---|---|---|---|
| 3,707,908 | 1/1973 | Merk et al. | 100/207 |
| 4,354,790 | 10/1982 | Karl | 100/207 |
| 4,981,031 | 1/1991 | Schneider et al. | 198/621.1 |
| 5,595,111 | 1/1997 | Michael et al. | 100/207 |
| 5,649,443 | 7/1997 | Shiroza et al. | 72/405.1 |
| 5,730,278 | 3/1998 | Baba et al. | 198/621.1 |

FOREIGN PATENT DOCUMENTS

| | | | |
|---|---|---|---|
| 58-212900 | 12/1983 | Japan | 100/207 |
| 3-106230 | 11/1991 | Japan . | |
| 6-142997 | 5/1994 | Japan . | |
| 6-218459 | 8/1994 | Japan . | |
| 6-262280 | 9/1994 | Japan . | |
| 7-164082 | 6/1995 | Japan . | |
| 844611 | 8/1960 | United Kingdom | 100/208 |

*Primary Examiner*—Stephen F. Gerrity
*Attorney, Agent, or Firm*—Wenderoth, Lind & Ponack, L.L.P.

[57] ABSTRACT

A transfer press, in which a work carrying-in or delivery apparatus (10) for feeding a work (5) into a press body (1), is provided at the upstream side of the press body. A transfer feeder is provided for sequentially transporting works to respective processing stations ($W_1$, $W_2$, $W_3$, . . . ) of the press body. A work transporting apparatus of the transfer press includes a cam shaft (16) which is provided at an upper portion on an upstream side of the press body and is rotatable by driving power taken from a slide driving mechanism of the press body. A loader cam (112*e*, 112*f*) and a feeding cam (13*a*) are mounted on the cam shaft. And, a rocking lever (112*a*) and a feeding lever (13*b*) are pivotably mounted at an upper portion on an upstream side of the press body. The driving mechanism for the work carrying-in apparatus includes the loader cam and the rocking lever, and the feeding mechanism for the transfer feeder includes the feeding cam and the feeding lever. The work carrying-in apparatus is driven in the feeding direction by rocking the rocking lever by the loader cam, and the transfer feeder is driven in the feeding direction by rocking the feeding lever by the feeding cam.

9 Claims, 19 Drawing Sheets

FIG. 1 -(PRIOR ART)

FIG. 2 - (PRIOR ART)

WORK CONVEYOR OF TRANSFER PRESS

BACKGROUND OF THE INVENTION

1. Technical Field

The present invention relates to a work transporting apparatus of a transfer press which includes a work transporting apparatus for feeding works into a press body and a transfer feeder for sequentially transporting works into respective processing stations in the press body.

2. Description of the Related Art

Conventionally, in a transfer press having a plurality of processing stations in a press body, a transfer feeder for sequentially transporting works to respective processing stations is provided.

Furthermore, on the upstream side of the press body, a disc stacker for separating stacked works one by one, is arranged. The work separated by the disc stacker is fed into the press body by a work transporting apparatus, and is subsequently transported into respective processing stations by the transfer feeder to be shaped in the respective processing stations.

The transfer feeders are arranged within the press body and are operable to transport the works into the respective processing stations. The transfer feeders are disclosed in Japanese Unexamined Patent Publication (Kokai) No. Heisei 6218459 and Japanese Unexamined Patent Publication No. Heisei 6-262280, for example.

The transfer feeder disclosed in the former publication has a pair of lifting beams extending in a feeding direction, which is vertically movable by a lift mechanism. A plurality of cross-bar carriers are supported on the lifting beams. The cross-bar, carriers are connected to each other and are reciprocally moved in the feeding direction by a feed mechanism arranged at the upper portion on an upstream side of the press body. In conjunction therewith, a cross-bar having a work suction means is transversely extended between adjacent cross-bar carriers. Then, the lift mechanism and the feed mechanism are arranged at the upper portion on the press body.

While the transfer feeder disclosed in the later publication has substantially the same construction as the transfer feeder disclosed in the former publication, the feed mechanism is arranged at the lower portion on an upstream side or a downstream side of the press body.

Meanwhile, in all of the conventional transfer feeders, while a lifting operation of the cross-bars is performed by the lift mechanism taking a servo motor as a driving source, and a feeding operation thereof is performed by the feed mechanism driven by the driving power taken from the press body, another driving source is employed for a work carrying-in or delivery apparatus which feeds the works into the press body. Thus, due to separate systems, the overall driving system becomes quite complicated and expensive.

On the other hand, in the case of the transfer feeder disclosed in the foregoing publication, because of a structure, in which the feed mechanism is directly coupled with the slide driving mechanism, there is no space between the slide driving mechanism and the feed driving mechanism to arrange a clutch which is necessary for solely driving the transfer feeder. Furthermore, since the feed mechanism projects from the front side of the press body, problems are encountered in that an upper frame becomes large and complicated, and, the crane may interfere with the foregoing feed mechanism upon exchanging dies, thus a wide space is necessary for locating the die exchanging position distant from the press body so as to avoid interference is required.

Furthermore, because of the construction in which the driving source of the lift mechanism is arranged at the upper portion on the upstream side or the downstream side of the press body and the respective lifting rods are driven up and down by the driving source, an equalizer means for establishing a synchronization of the respective lifting rods becomes necessary, thus making the construction complicated. Furthermore, vibration of the lifting rods and so forth may be amplified by play caused in the equalizer means and may be a cause of noise and mis-feeding. In addition, since a large size and large capacity servo motor is required, the apparatus becomes expensive.

On the other hand, in the transfer feeder disclosed in the later publication, since the feed mechanism is placed at the lower portion of the press body, it may interfere with installation of the work carrying-in apparatus when the feed mechanism is located on the upstream side, and in an installation of a product feeding out apparatus when the feed mechanism is located on the downstream side.

The present invention is provided to improve the drawbacks set forth above, and therefore, it is an object of the present invention to provide a work transporting apparatus of a transfer feeder, which can drive the work feeding apparatus and the transfer feeder with a common driving system so as to simplify of the driving system and lowering costs.

On the other hand, as the work carrying-in apparatus for feeding the work into the press body, the apparatus shown in FIG. 1, has been employed, for example.

Namely, the work "b", separated one-by-one by a destacker "a" is washed by a washing apparatus "c" and thereafter transported into a centering apparatus "e" by a belt feeder "d" to be positioned at a predetermined position.

On the upper portion of centering apparatus "e" a carrier of the work carrying-in apparatus "f" is provided in movable fashion in a feeding direction (arrow A). The carrier "g" is connected to the lower end of a rocking lever "h" via a link "i".

The rocking lever "h" is pivotally connected to an apparatus body at the upper end thereof so that it may be swung in synchronism with an operation of the press body "i" by means of a cam "k" rotated by a driving power taken from the press body "j". By this, the foregoing carrier "g" is reciprocally driven in the feed direction A.

Furthermore, at the lower portion of the carrier "g", a work supporting arm "m" is projected. On the tip end of the work supporting arm "m", a work suction means "n" like a vacuum cap is provided. The arrangement is so constructed that when the suction means "n" sucks the work "b" positioned by the centering device, the work "b" is lifted up by an elevation of a lifting beam "p" to the position shown by the phantom line in FIG. 1 by a lifting drive device "q", and then fed into a press body "j" by a movement of the carrier "g".

In the meantime, in the foregoing conventional work carrying-in apparatus, since the rocking lever "h" is pressed onto a cam "k" by a reaction cylinder "o" the cam "k" has to cause rocking motion of the rocking lever "h" against the force of the reaction cylinder "o" requiring a large driving torque which causes a large power consumption. Also, since it is required to accommodate the reaction cylinder "o" or a large diameter air piping in the cam box, the cam box becomes bulky and makes the overall apparatus expensive.

On the other hand, because of a structure, in which the rocking lever "h" and the carrier "g" are connected by means of a link "i" an angle of the link "i" is varied when a height of the carrier "g" is varied due to variation of a work transportation height (path line). As a result, when the work "b" is sucked and elevated to the path line, the carrier "g" may be rocked in the feeding direction as shown by the broken line in FIG. 2 to possibly cause a mis-feeding due to a falling down of the sucked work "b".

In order to improve such drawbacks, a long length is provided for the link in the prior art so that the angle of the link does not vary significantly even when the path line is varied. When a longer length is provided for the link "i", a positional relationship between the rocking lever "h" and the carrier "g" is restricted, or the rocking lever "h" is arranged on the upstream side to make the overall apparatus bulky.

Another purpose of the present invention is to improve the above drawbacks. It is therefore an object of the present invention to provide a work carrying-in or delivery apparatus of a transfer feeder which is not influenced by variations of a path line and can be driven by a smaller driving force.

SUMMARY OF THE INVENTION

In order to accomplish the above-mentioned objects, according to one aspect of the present invention, a transfer press, in which a work carrying-in or delivery apparatus for feeding a work into a press body, is provided at the upstream side of the press body and a transfer feeder for sequentially transporting works in respective processing stations of the press body, is provided in the press body.

A work transporting apparatus of the transfer press comprises a cam shaft provided at an upper portion on an upstream side of the press body. The cam shaft is rotated by a driving power taken from a slide driving mechanism of press body. A loader cam and a feeding cam are respectively mounted on the cam shaft. A rocking lever and a feeding lever are pivotably mounted at an upper portion on an upstream side of the press body. A driving mechanism of the work carrying-in apparatus consists of the loader cam and the rocking lever. A feeding mechanism of the transfer feeder consisting of the feeding cam and the feeding lever. The work carrying-in apparatus is driven in the feeding direction by rocking the rocking lever by the loader cam and driving the transfer feeder in the feeding direction by rocking the feeding lever by the feeding cam.

According to the construction as set forth above, since the work carrying-in apparatus and the transfer feeder can be driven simultaneously by the cam shaft which is arranged at the upper portion on the upstream side of the press body, the construction is simplified in comparison with the conventional devices, in which the driving systems are separate, and thus the present invention provides the apparatus at a lower cost.

Furthermore, by making the cam shaft common for both the work carrying-in apparatus and the transfer feeder, a phase shift between will not occur. Also, by making parts which are in common to both systems, the number of parts can be reduced so as to lower costs.

In the construction set forth above, it is preferred that the cam shaft perpendicularly intersects with the feeding direction.

According to this construction, by arranging the cam shaft so that it is perpendicular to the feeding direction, the cam box housing the driving mechanism and the feeding mechanism may not project frontward in significant magnitude. Therefore, the feeding mechanism may not interfere with a crane or the like upon exchanging the dies, thus making it unnecessary to locate the die exchanging position a significant distant from the center of the press body. Therefore, a space required for exchanging the dies can be small.

Furthermore, in the foregoing construction, it is desirable that a clutch means is provided between the slide driving mechanism and the cam shaft.

According to this construction, by providing the clutch between the slide driving mechanism and the cam shaft. The work carrying-in apparatus and the transfer feeder can be driven individually independent of the work body. Therefore, an adjusting operation can be easily performed.

Furthermore, in the construction as set forth above, it is desirable that the loader cam and the feeding cam are constructed of positive cams.

According to this construction, by constructing the loader cam and the feeding cam as positive cams, a reaction cylinder for depressing the rocking lever or the feed lever becomes unnecessary. Therefore, the driving power is not wasted by the reaction cylinder. Also, piping becomes unnecessary which results in reduced costs. Furthermore, the width of the cam box can be reduced.

Another aspect of the present invention for accomplishing the above-mentioned objects is directed to a work carrying-in or delivery apparatus of a transfer press for feeding a work into a press body from an upstream side of the press body. The apparatus comprises a loader positive cam which is pivoted by driving power taken from a slide driving mechanism of the press body.

A rocking lever is pivotably mounted at the upper portion on an upstream side of the press body and is rocked by the loader cam.

The apparatus also includes lifting beams, supported by lifting means, in a vertically movable fashion.

A carrier is reciprocally movable in a feeding direction along the lifting means.

And, a slider mechanism is disposed between a lower end of the rocking lever and the carrier for converting rocking motion of the rocking lever into reciprocal motion of the carrier.

Also, a plurality of work supporting arms, which each include a base end portion supported on the carrier and a tip end provided with work suction means.

According to the construction set forth above, by employing the loader positive cam in the driving portion, it becomes unnecessary to depress the rocking lever onto the cam by means of the reaction cylinder under pressure. Thus, the driving power is not be wasted by the reaction cylinder, and the work carrying-in apparatus can be driven with a small driving power. Furthermore, since an accommodation of the reaction cylinder in the cam box piping and so forth becomes unnecessary, the overall apparatus is more compact and lower in cost.

On the other hand, since the rocking lever and the carrier are connected via the slider mechanism, even when the lifting stroke of the carrier is varied due to variation of the path line or so forth, the positional relationship in the feeding direction between the rocking lever and the carrier may is be varied. The carrier may not be rocked in the feeding direction during a lifting operation while sucking the work. By this, drawbacks, such as mis-feedings caused by a drop down of the work from the suction means are avoided.

Furthermore, since the apparatus is not restricted by the distance between the rocking lever and the carrier, in contrast to the conventional case where the rocking lever and the carrier are connected by the link, the freedom in designing can be significantly improved. Furthermore, since the rocking lever does not project excessively toward the upstream side, a down-sizing of the apparatus can be achieved.

In the construction set forth above, it is desirable that the lifting means employs a servo motor as a driving source.

According to this construction, by employing the servo motor to provide the driving power for the lifting means, the lifting stroke can be freely varied depending upon a variation of the path line. Even when the path line is varied, it can be adapted only by a variation of the lifting stroke, thus the operation to vary the height of the centering apparatus as in the prior art, depending upon the path line or so forth is not necessary.

Furthermore, in the foregoing construction, it is desirable that a position of a direction perpendicularly intersecting with the feeding direction of the work supporting arm, is adjustable by a width direction adjusting means. Also, it is desirable that a position of a feeding direction of the work supporting arm is adjustable by a feeding direction adjusting means.

According to this construction, by making the work supporting arm adjustable in the width direction and the feeding direction by the width adjusting means and the feeding direction adjusting means, respectively, it becomes possible to suck at the optimal position depending upon the size of the work to be fed. Also, the work can be fed into the transfer press in a stable attitude. Also, even with a work in which the holes and so forth are made in the vicinity of the center of gravity by preliminary processing, it becomes possible to carry the work in by automatic adjustment of the sucking position. Therefore, it becomes unnecessary to perform operation for adjusting the position of the work sucking means by worker in an internal setup as in the prior art.

BRIEF DESCRIPTION OF THE DRAWINGS

The present invention will be understood more fully from the detailed description given herebelow and from the accompanying drawings of the preferred embodiment of the invention, which, however, should not be taken as limiting the present invention, but are for explanation and understanding only.

In the drawings.

DETAILED DESCRIPTION OF THE INVENTION

The preferred embodiment of a work feeding apparatus for a transfer press according to the present invention will be discussed hereinafter with reference to the accompanying drawings.

Initially, a detailed discussion will be given for an example, in which a work feeding apparatus of the present invention is applied to a module transfer press, with reference to the drawings.

Figure 3:
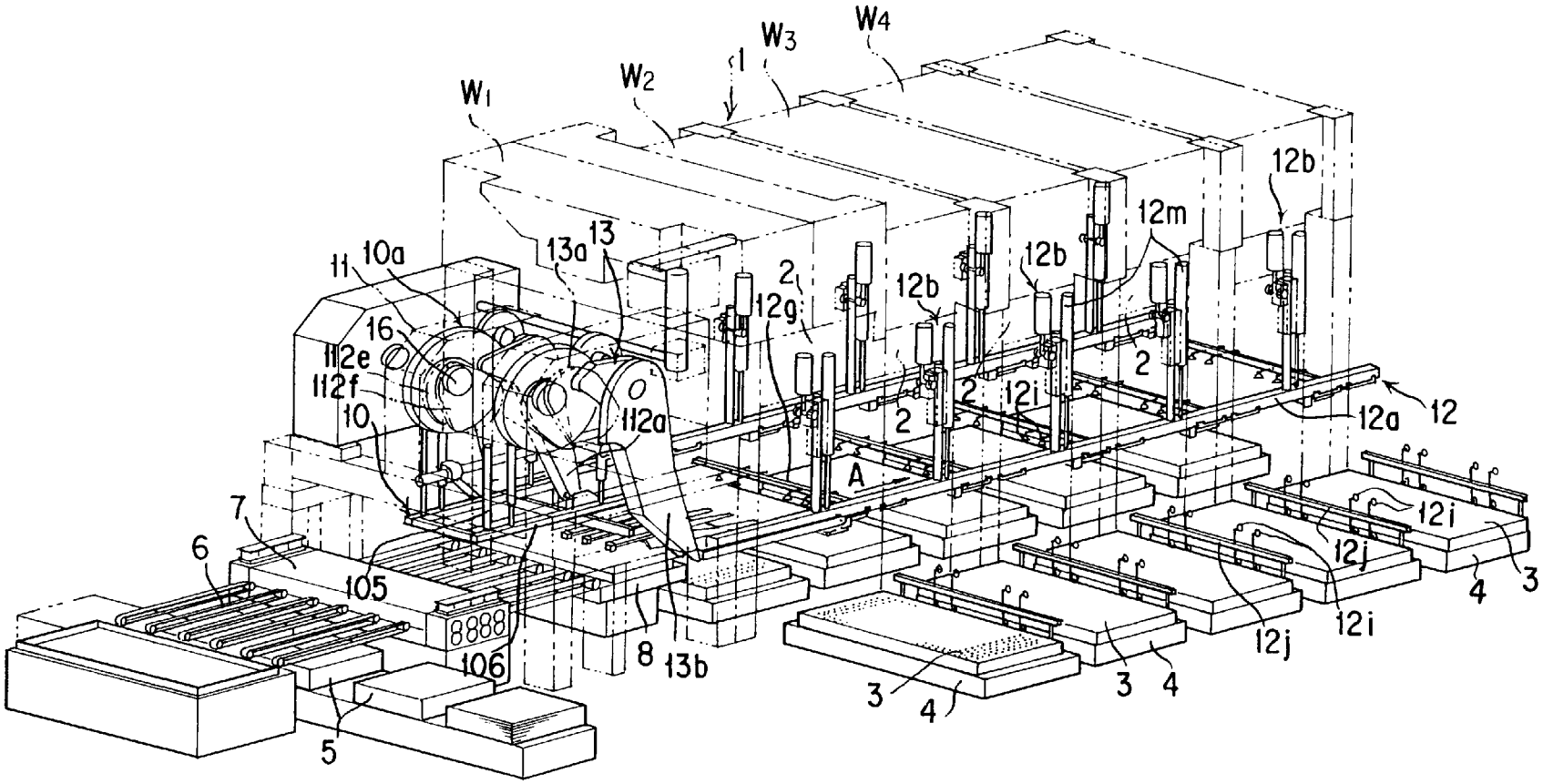
FIG. 3 is a perspective view of a transfer press, in which one embodiment of a work transporting apparatus according to the present invention is provided.
Figure 4:
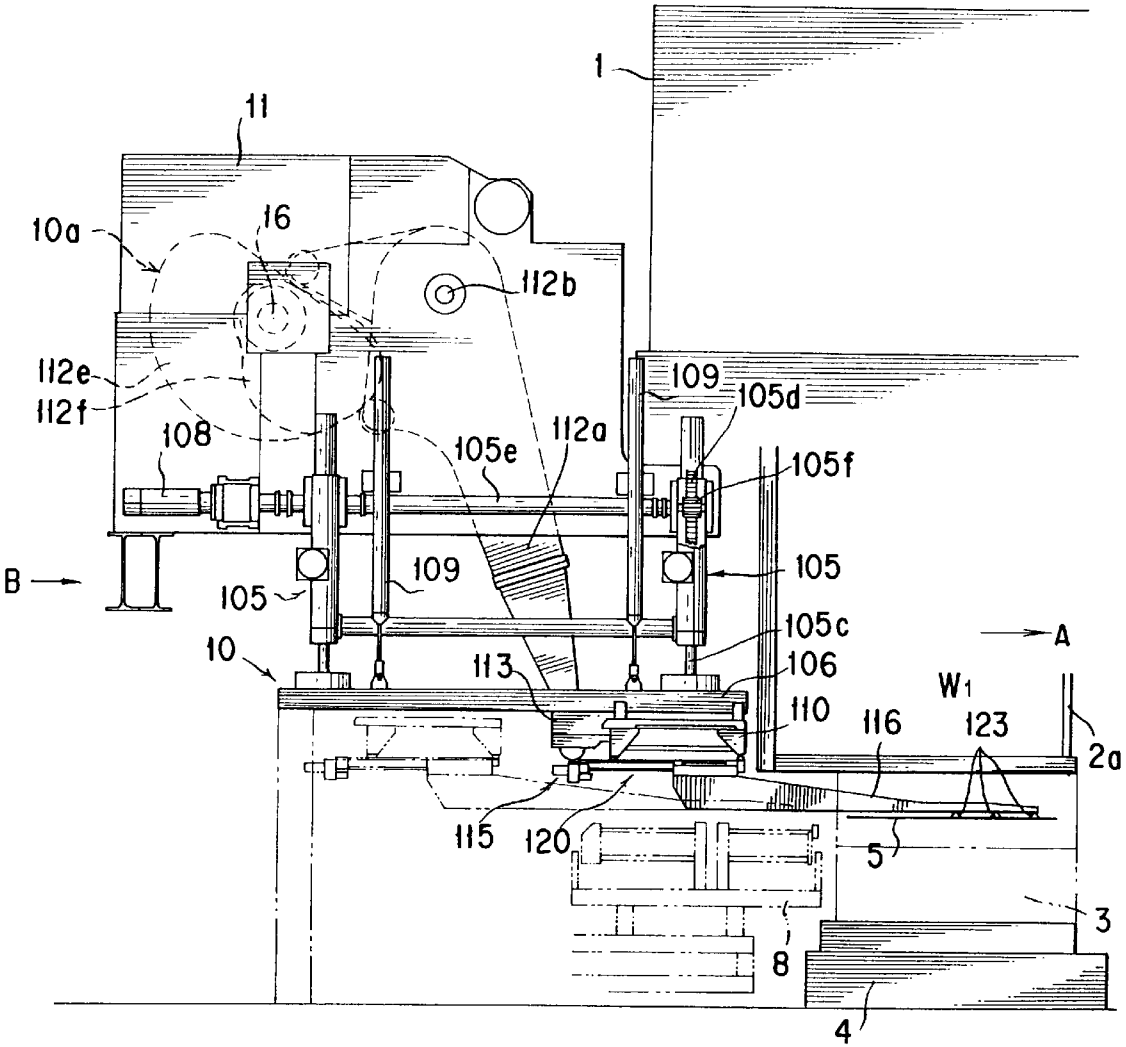
FIG. 4 is a front elevational view of a work carrying-in apparatus forming part of the foregoing embodiment of the work transporting apparatus.
Figure 5:
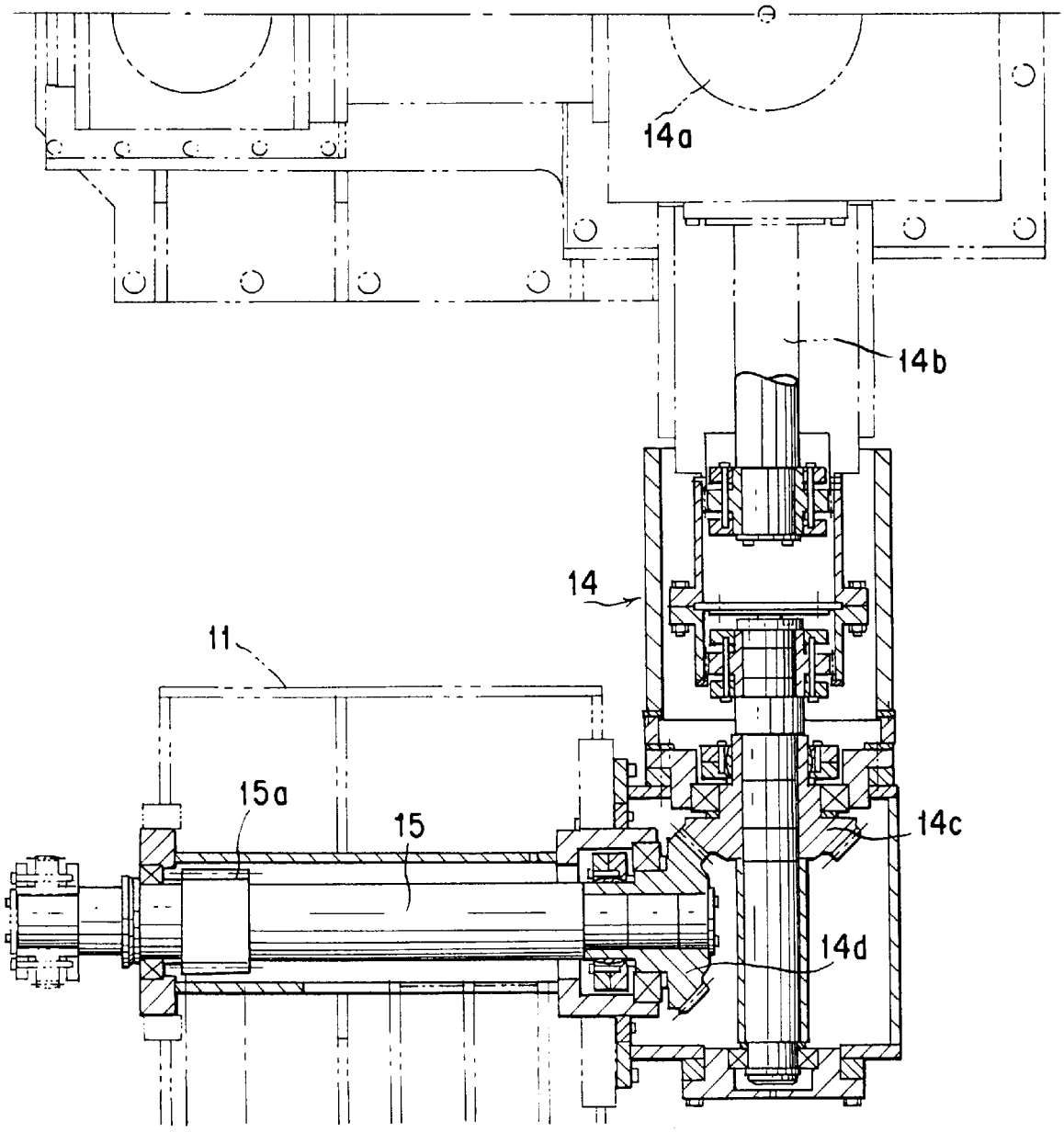
FIG. 5 is a sectional view showing a driving power taking out mechanism for taking out driving power from the foregoing embodiment of the transfer press.
Figure 6:
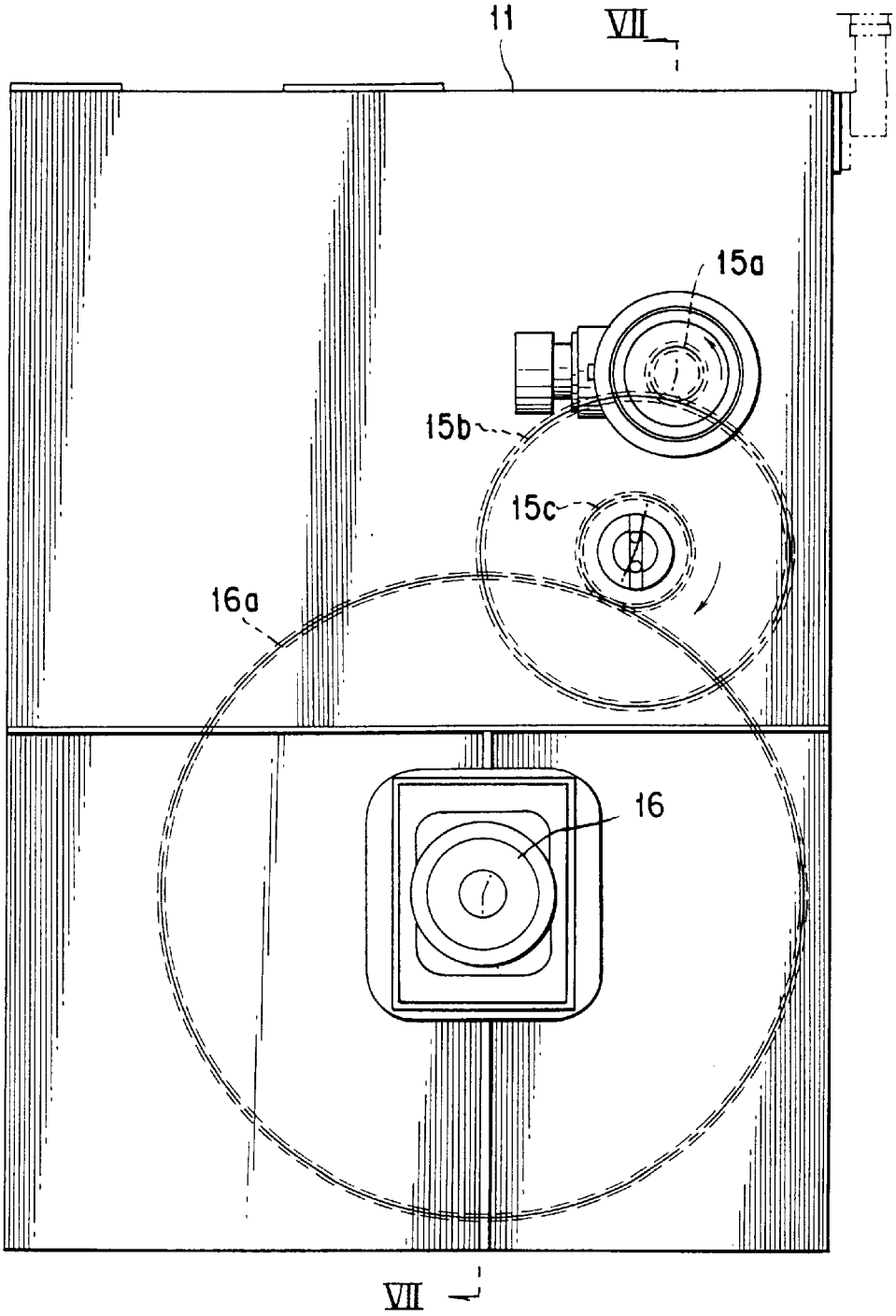
FIG. 6 is a front elevational view showing a cam box of the work transporting apparatus shown in FIG. 3.

FIG. 3 is a perspective view showing the overall construction of the module transfer press, and FIG. 4 is a front elevational view showing the work transporting apparatus incorporated therein.

A body 1 of the module transfer press (hereinafter referred to as press body) has a construction, in which a slide driving mechanism 2 and a slide 2*a* are provided. The slide 2*a* is vertically driven by the slide driving mechanism 2 per each of processing stations $W_1$, $W_2$, $W_3$, . . . The press body also has moving bolsters 4 that are each mounted with dies 3 and are movable into and out of each of the processing stations $W_1$, $W_2$, $W_3$, . . . , respectively.

Furthermore, on the upstream side of the press body 1, a destacker 6 is provided for separating stacked sheet-form works or workpieces one-by-one from the top of the stack. A work or workpiece 5, separated by the destacker 6, is fed into a centering apparatus 8 after washing thereof by a washing apparatus 7. After the work 5 is centered, it is fed into a first processing station $W_1$ the press body 1 by a work carrying-in apparartus 10 provided at an upper portion of the centering apparatus 8.

A drive mechanism 10*a* of the work carrying-in apparatus 10 is housed within a cam box 11 provided in the upper portion on the upstream side of the press body 1, together with a feed mechanism 13 of a transfer feeder 12 which will be discussed later.

In an upper portion of the cam box 11, a driving power taking out apparatus 14 for taking out driving power from a slide driving mechanism of the press body 1.

The driving power taking out apparatus 14 has a driving power taking out shaft 14*b* connected to the slide driving mechanism via a clutch means 14*a*. Driving power taken from the driving power take out shaft 14*b* is transmitted to a drive shaft 15 provided in the upper portion of the cam box 11 via bevel gears 14*c* and 14*d*.

A pinion 15*a* is provided on the drive shaft 15. The pinion 15*a* is meshed with a large gear 16*a* provided on a cam shaft 16 via intermediate gears 15*b* and 15*c*.

Figure 7:
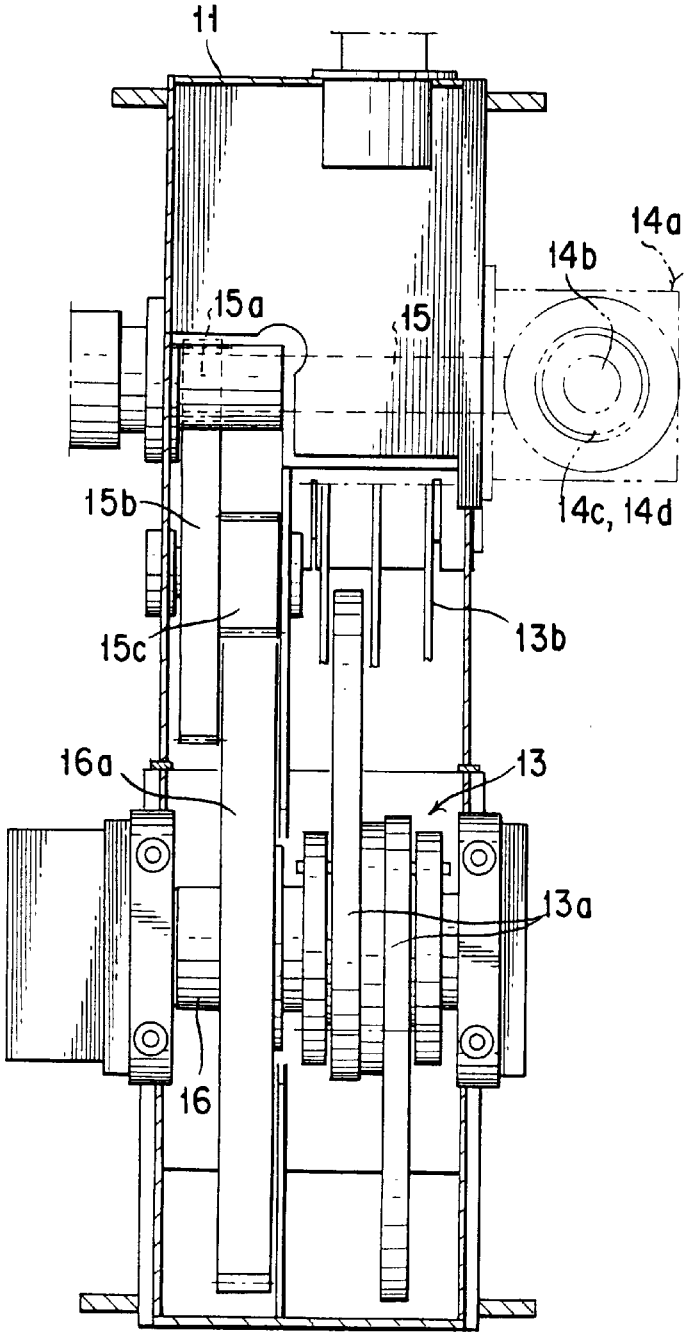
FIG. 7 is a sectional view taken along line VII—VII of FIG. 6.
Figure 8:
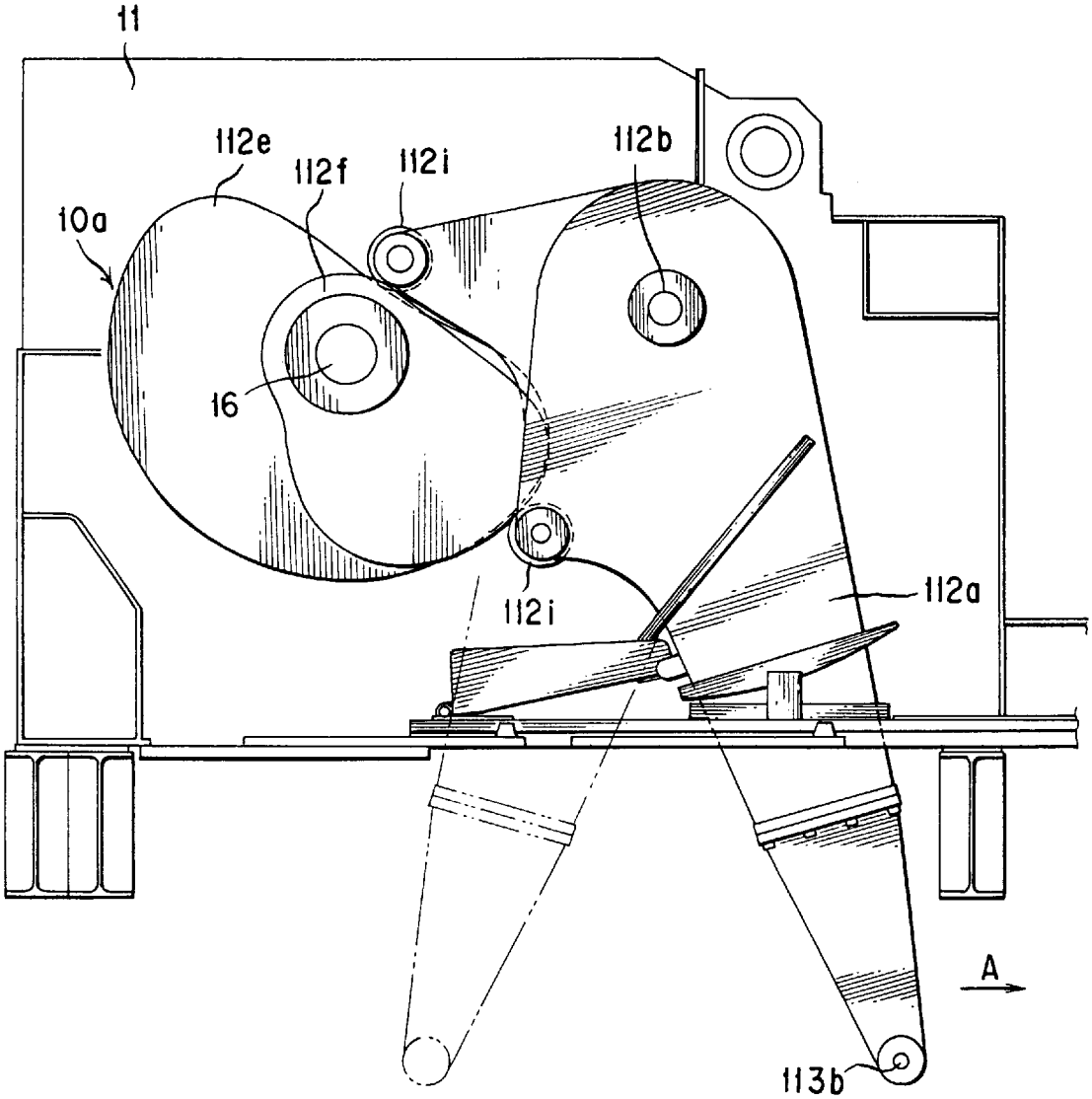
FIG. 8 is a front elevational view showing a drive mechanism of the work carrying-in apparatus of the work transporting apparatus as shown in FIG. 3.

Then, as shown in FIGS. 7 and 8, two positive cams 112*e* and 112*f* the drive mechanism 10*a* are provided fro loading and a positive cam 13*a* of the feeding mechanism 13 is provided for feeding.

As shown in FIG. 8, two cam followers 112*i* provided on the upper end side of rocking lever 112*a*, the upper end of which is rockably supported by a support shaft 112*b*, are in contact with the periphery of positive cams 112*e* and 112*f*, respectively. By rotation of the positive cams 112*e* and 112*f*, the lower end side of the rocking lever 112*a* is rocked toward a feeding direction A around the support shaft 112*b*.

Then, the lower end of the foregoing rocking lever 112*a* is connected to the carrier which is supported by a lifting beam 106. Associating with rocking of the rocking lever 112*a*, the carrier 110 is reciprocally moved toward the feeding direction A.

The lifting beam 106, which supports the carrier 110, is moved vertically by the lifting means 105.

As shown in FIG. 4, the lifting means 105 has a lifting motor 108, which is a servo motor, for rotating a pinion 105*f* via a drive shaft 105*e*.

The pinion 105*f* is in mesh with a rack 105*d* formed on a lifting rod 105*c* which supports the lifting beam 106 in vertically movable fashion, thus each lifting beam 106 can be moved vertically by rotation of the pinion 105*f* via each lifting rod 105*c*. Thus, the carrier 110 is also moved vertically.

A base end portion of a work supporting arm 116 is mounted on the lower portion of the foregoing carrier 110.

A work sucking means 123 is mounted on a tip end side of the work supporting arm 116. The work sucking means 123 sucks the work 5, centered by the centering apparatus 8, so as to feed it into the first processing station $W_1$ in the press body 1.

Figure 9:
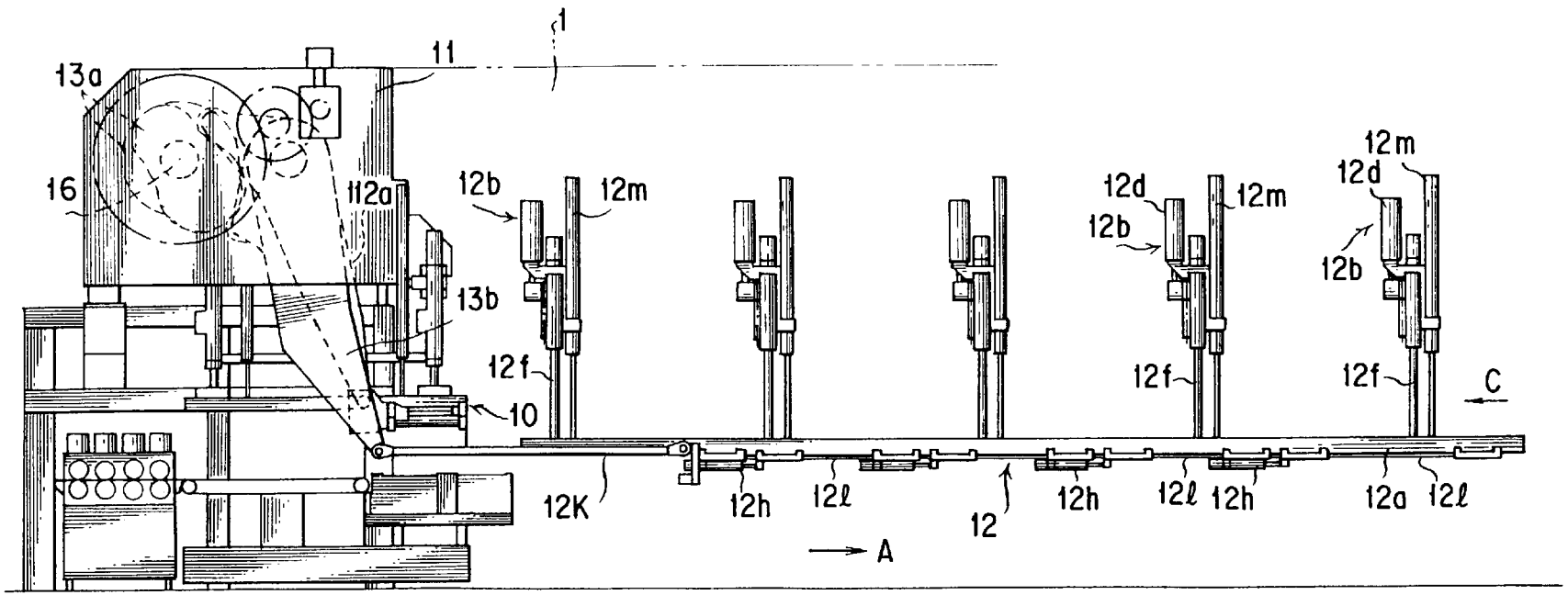
FIG. 9 is a front elevational view of a transfer feeder of the work transporting apparatus shown in FIG. 3.
Figure 10:
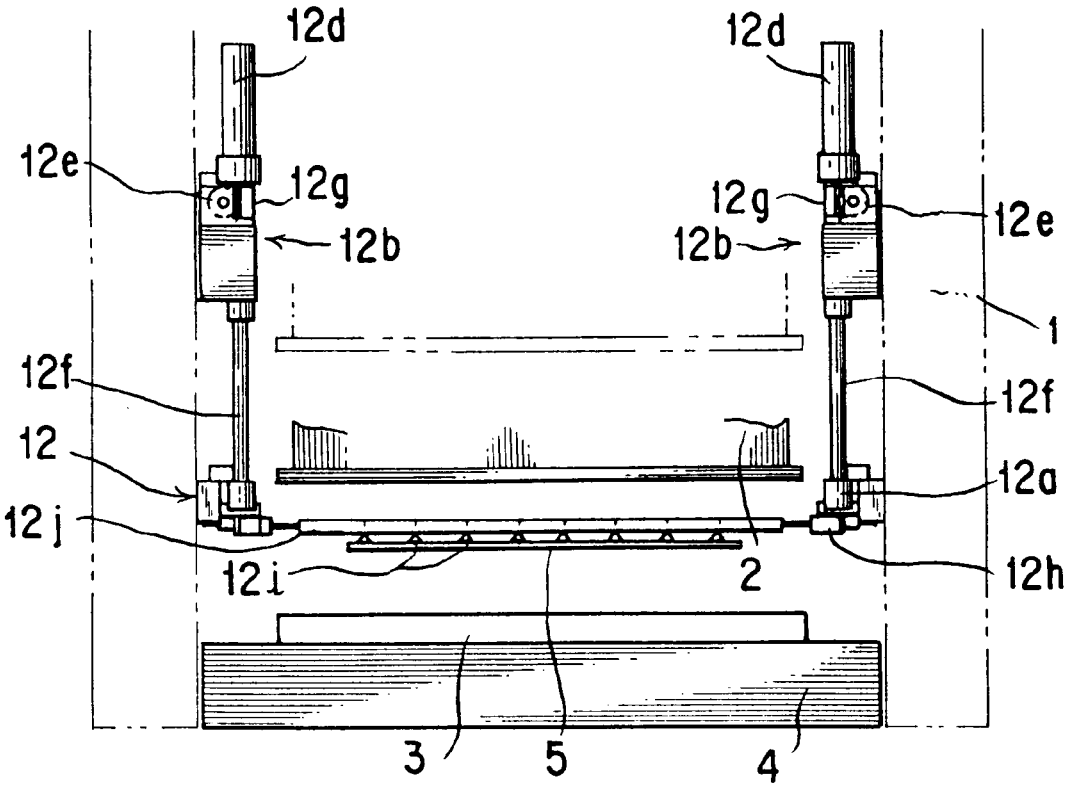
FIG. 10 is a sectional view of a transfer feeder of the work transporting apparatus shown in FIG. 3.

The transfer feeder 12, incorporated in the press body 1, has a pair of lifting beams 12*a* arranged in parallel to the feeding direction A, as shown in FIGS. 9 and 10. These lifting beams 12*a* are vertically movable by a lifting means 12*b*.

The foregoing lifting means 12*b* is provided in a plurality of positions along the longitudinal direction of the lifting beam 12*a* and each has a lifting motor 12*d* consisting of a servo motor, a synchronization of which is controlled. By these lifting motors 12*d*, pinions 12*e* are rotated, respectively.

Each pinion 12*e* is meshed with a rack 12*g* formed on a lifting rod 12*f* which is connected to the lifting beam 12*a*. By rotation of each pinion 12*e*, each lifting rod 12*f* is vertically moved so as to move the lifting beam 12*a* vertically.

A plurality of cross-bar carriers 12*h* are supported on the lifting beam 12*a* at intervals in the longitudinal direction.

These cross-bar carriers 12*h* are mutually connected by a connecting rod 121, and are movable in the feeding direction simultaneously. Between adjacent cross-bar carriers 12*h*, a cross-bar 12*j* having work suction means 12*i* is extended transversely. It should be noted that in FIG. 9, 12*m* denotes a balance cylinder which is upwardly biases the lifting beam 12*a*.

Furthermore, the lower end of a feeding lever 13*b* is connected via a link 12*k* to the cross-bar carrier 12*h*, which is located on the most upstream side.

Figure 11:
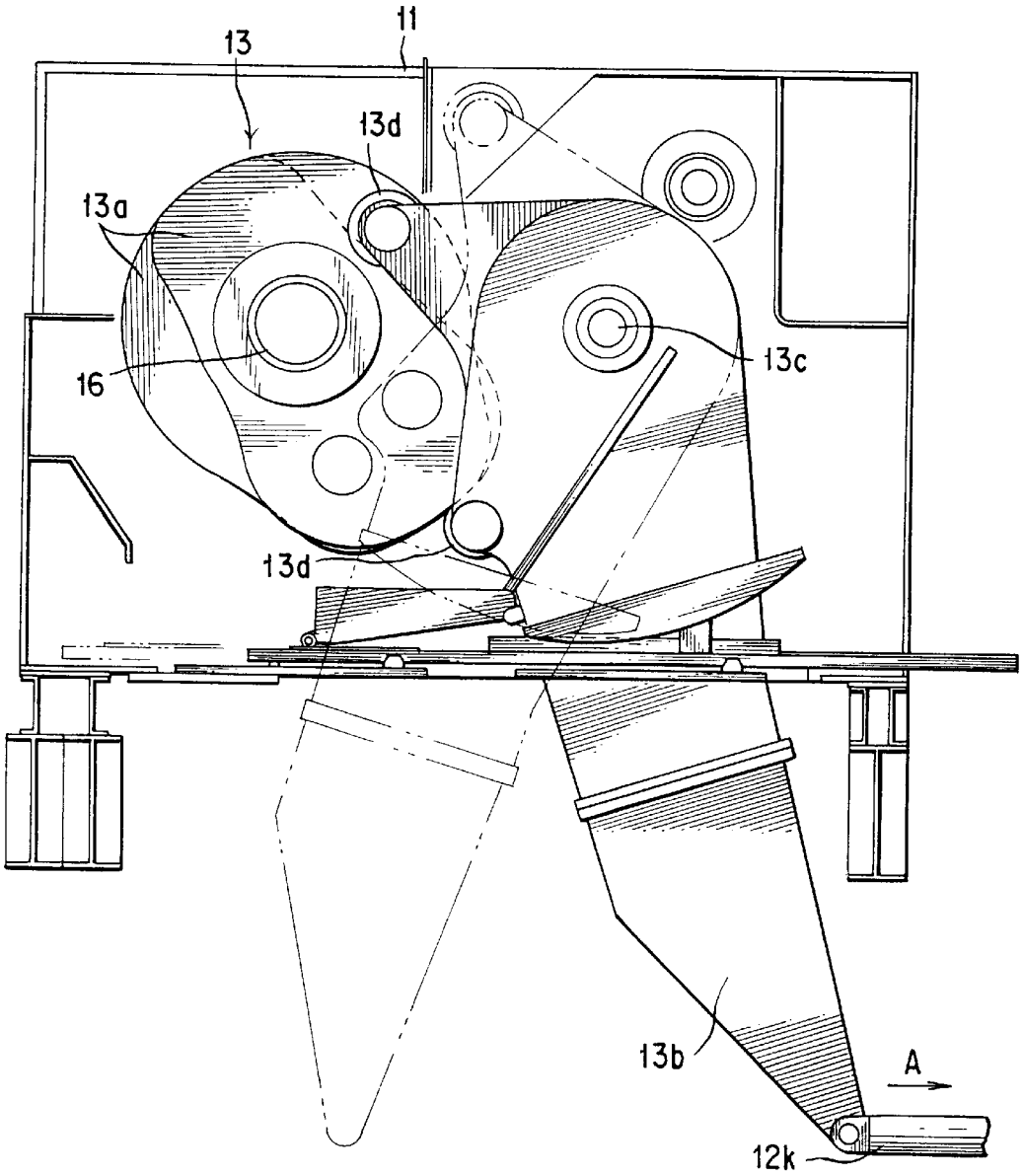
FIG. 11 is a front elevational view showing a feeding mechanism of the transfer feeder forming the work carrying-in apparatus of the work transporting apparatus shown in FIG. 3.

The feeding lever 13*b* is pivoted at the upper end by a support shaft 12*c* in the cam box 11 provided with the feeding mechanism 13, as shown in FIG. 11. Then, two cam followers 13*d* pivotably mounted on the upper end side of the feeding lever 13*b* are contacted with respective peripheries of the positive cams 13*a* for feeding. In accordance with rotation of the positive cams 13*a* for feeding, the feeding lever is rocked to reciprocally move the cross-bar carrier 12*h* mounted on the lifting beam 12*a*, in the feeding direction A.

Next, a discussion will be given for operation of the work transporting apparatus constructed as set forth above.

Initially, the works 5 are separated one-by-one by destacker 6 and are then fed into the centering apparatus 8. Then, the work carrying-in apparatus 10, placed in stand-by state in the upper portion, feeds the works 5 in synchronism with the operation of the press body 1 in the following manner.

The lifting beam 16 is lowered by the lifting means 105 to lower the carrier 110 which is stopped at the stand-by position. Then, the work sucking means 123, provided on the work supporting arm 116, sucks the work 5 from above the work.

Subsequently, when the work 5 is lifted up in the vicinity of the path line by the lifting means 105, the rocking lever 112*a* is driven in a rocking motion by the positive cams 112*e* and 112*f* for loading. By this, the carrier 110 is shifted in the feeding direction A so that the work 5, sucked by the work sucking means 123, is fed into the first processing station $W_1$ in the press body 1.

Thereafter, the work supporting arm 116 having released the work 5 is returned to the initial position together with the carrier 110. In conjunction therewith, the slider 2*a* is lowered by the slide driving mechanism 2 to perform processing of the work 5 at the respective processing stations $W_1$, $W_2$, $W_3$ . . . .

When processing in the respective processing stations $W_1$, $W_2$, $W_3$, . . . is completed and elevation of the slide 2*a* is started, the lifting lever 13*b* is rocked by the positive cam 13*a* to shift the cross-bar carrier 12*h* above the lifting beam 12*a* toward the upstream side of the stand-by position. When the cross-bar 12*j* reaches the positions above the respective processing stations $W_1$, $W_2$, $W_3$, . . . , the lifting beam 12*a* is lowered by the lifting means 12*b*. Thus, the work sucking means 12*i* provided on each cross-bar 12*j* sucks the work 5, processing of which is completed.

Then, the lifting beam 12*a* is elevated by the lifting means 12*b* in this condition until reaching the work 5 at a position in the vicinity of the path line. The feed lever 13*b* is again rocked by the positive cam 13*a* for feeding to shift the cross-bar carrier 12*h* in the feeding direction A. Then, when the work 5 is sucked by the work sucking means 12*i*, the work is transported into the next processing stations $W_2$, $W_3$, $W_4$, . . . for performing the next processing thereof.

Figure 12:
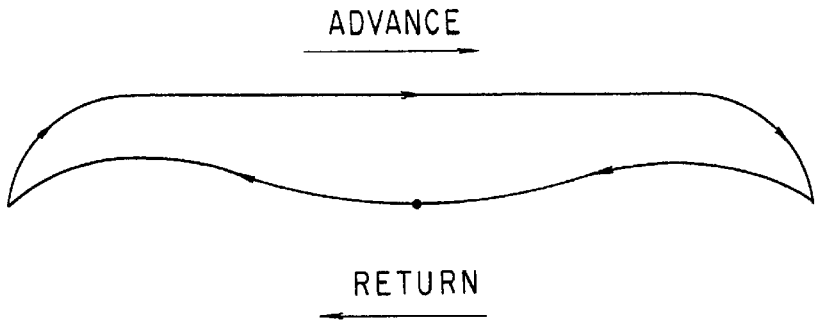
FIG. 12 is a diagrammatic illustration showing a motion curve of the foregoing transfer feeder.

It should be noted that a motion curve of the work sucking means 2*i* in the foregoing operation is illustrated in FIG. 12.

Hereinafter, by repeating the foregoing operation by respective processing stations $W_1$, $W_2$, $W_3$, . . . processing of the work 5 is performed sequentially. In conjunction therewith, the work 5, processing of which is completed in the final processing station $W_n$, is fed out from the press body 1 by a work feeding out apparatus (not shown).

It should be noted that the example, in which the present invention is implemented in the module transfer press of the foregoing embodiment, the invention ie, of course, applicable for a general transfer press, in which the press body is integrated.

Next, the work carrying-in apparatus of the foregoing work transporting apparatus will be discussed in detail.

Figure 13:
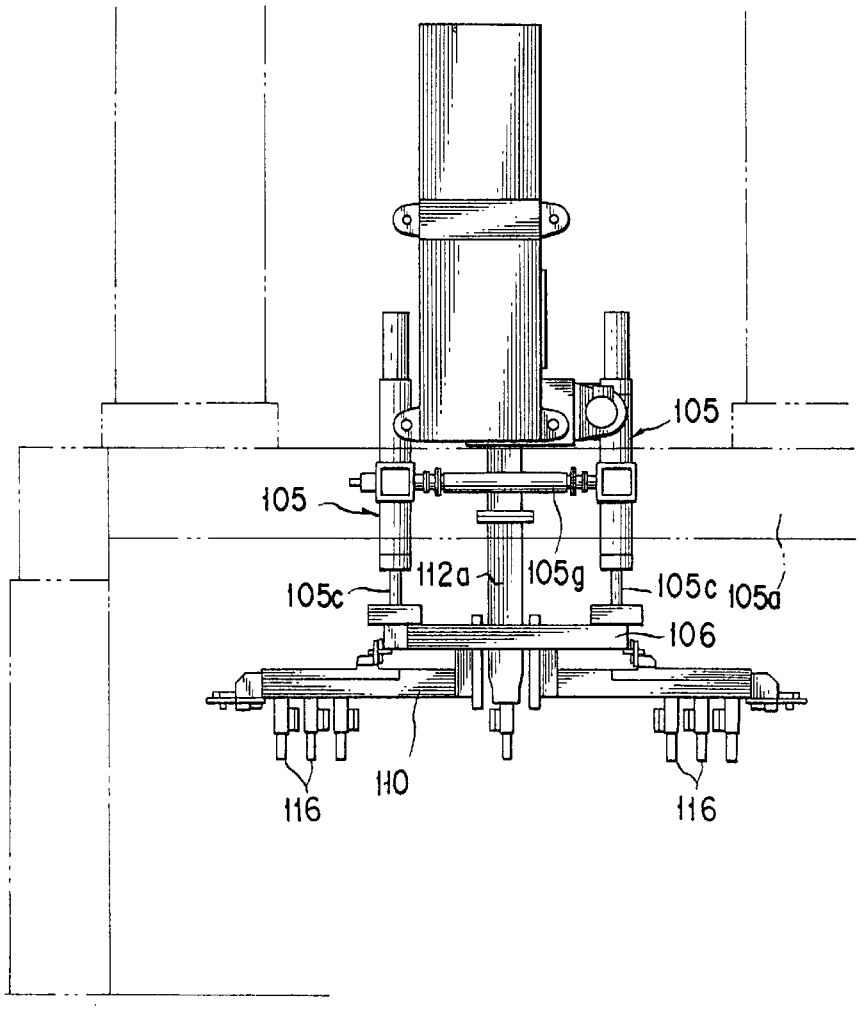
FIG. 13 is an illustration of the work carry-in apparatus as viewed in a direction of arrow B of FIG. 4.
Figure 14:
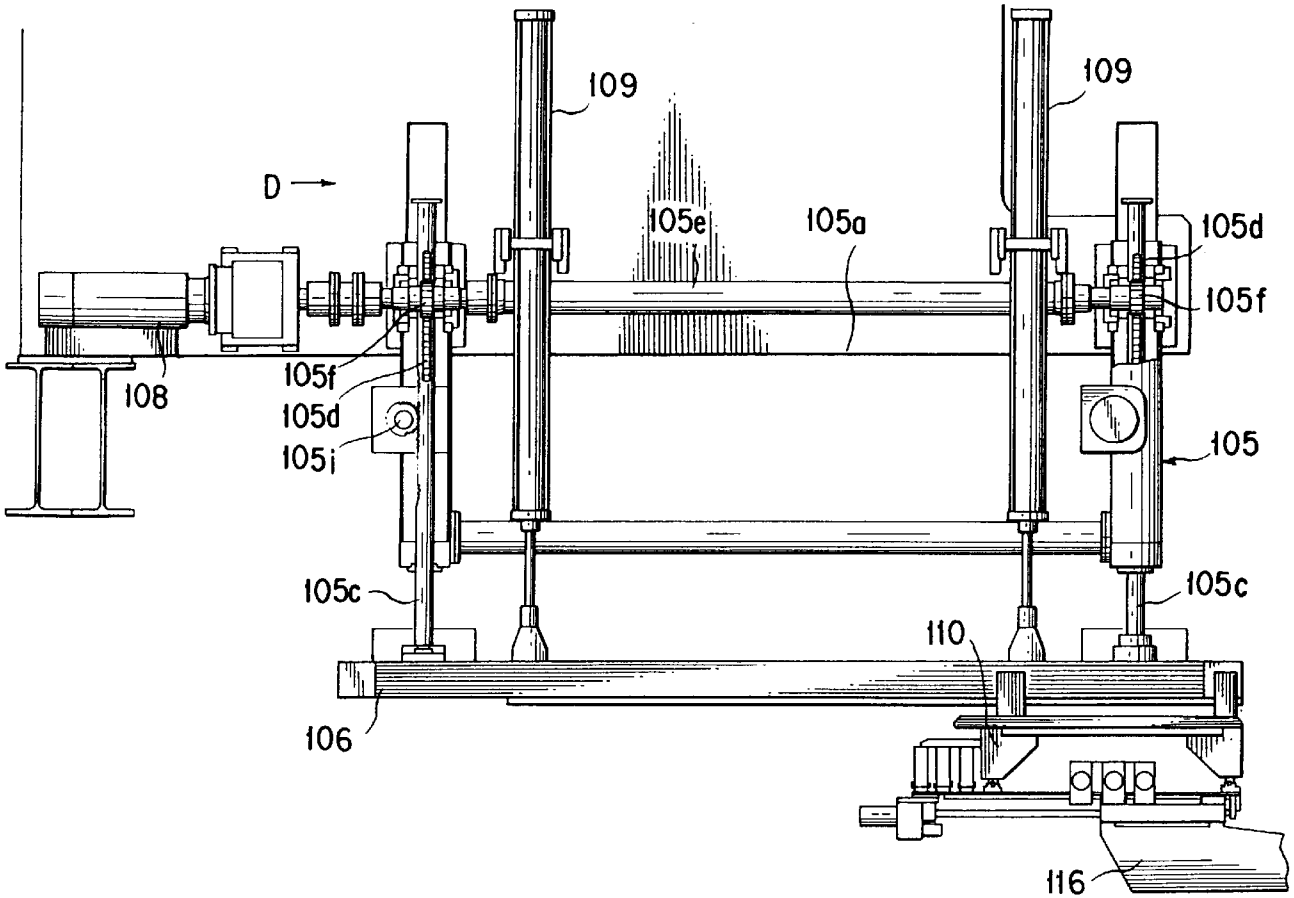
FIG. 14 is a partially cut-out elevational view showing a lifting means of the foregoing work carrying-in apparatus.
Figure 15:
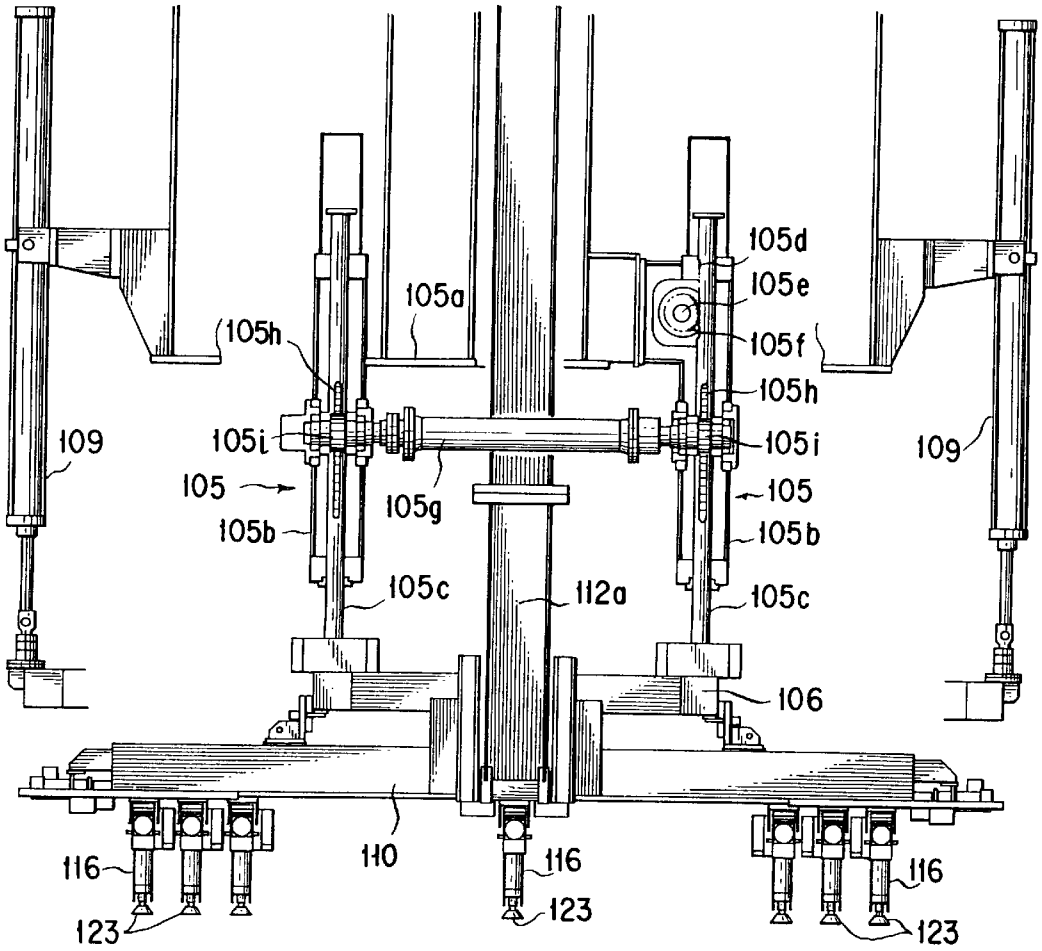
FIG. 15 is an illustration of the lifting means as viewed in a direction of arrow D of FIG. 14.

FIG. 13 is an illustration as viewed in the direction B of FIG. 4. and FIG. 14 is a major part of the enlarged illustration of FIG. 4 and FIG. 15 is an illustration as viewed in the direction D of FIG. 14.

As set forth above, the foregoing work carrying-in apparatus 10 has the lifting means 105 provided in the upper portion thereof. The carrier 110 is supported on the lifting beam 106 to be moved vertically by the lifting means 105.

As shown in FIGS. 13 to 15, the foregoing lifting means 105 is provided at four positions at back and forth and left and right positions, and has guide cylinders 105*b* supported on platforms 105*a*, respectively. The lifting rods 105*c* in the guide cylinders 105*b* are supported slidably in a vertical direction.

The racks 105*d* are formed in the upper portion of the lifting rods 105*c* located on the left and right sides of the apparatus. The pinions 105*f*, secured on the drive shaft 105*e*, are meshed with the racks 105*d*. The lifting motor 108, consisting of the servo motor, is drivingly connected to the upstream side end of the drive shaft 105*e* to cause the driving shaft 105*e* to rotate in forward and reverse directions. Thus, the left and right lifting rods 105*c* are simultaneously driven vertically.

It should be noted that the front and rear lifting rods 105 are connected by an equalizer shaft 105*g*.

The rack 105*h* is formed in a substantially intermediate portion of the front and rear lifting rods 105*c* located on the upstream side (left side of FIG. 14). The pinions 105*i*, connected to the equalizer shaft 105*g*, are meshed with racks 105, respectively. By this construction, the front and rear lifting rods 105*c* are moved vertically in synchronism with the vertical motion of the left and right lifting rods 105*c*.

Furthermore, on the lower end of the lifting rod 105*c*, the lifting beam 106 are mounted horizontally.

It should be noted that, in FIGS. 13, 14 and 15, reference numeral 109 denotes a balance cylinder biasing the lifting beam 106 upwardly to lower the load on the lifting means 105.

The carrier 110 is supported reciprocally in the feeding direction A on the lifting beam 106.

Figure 16:
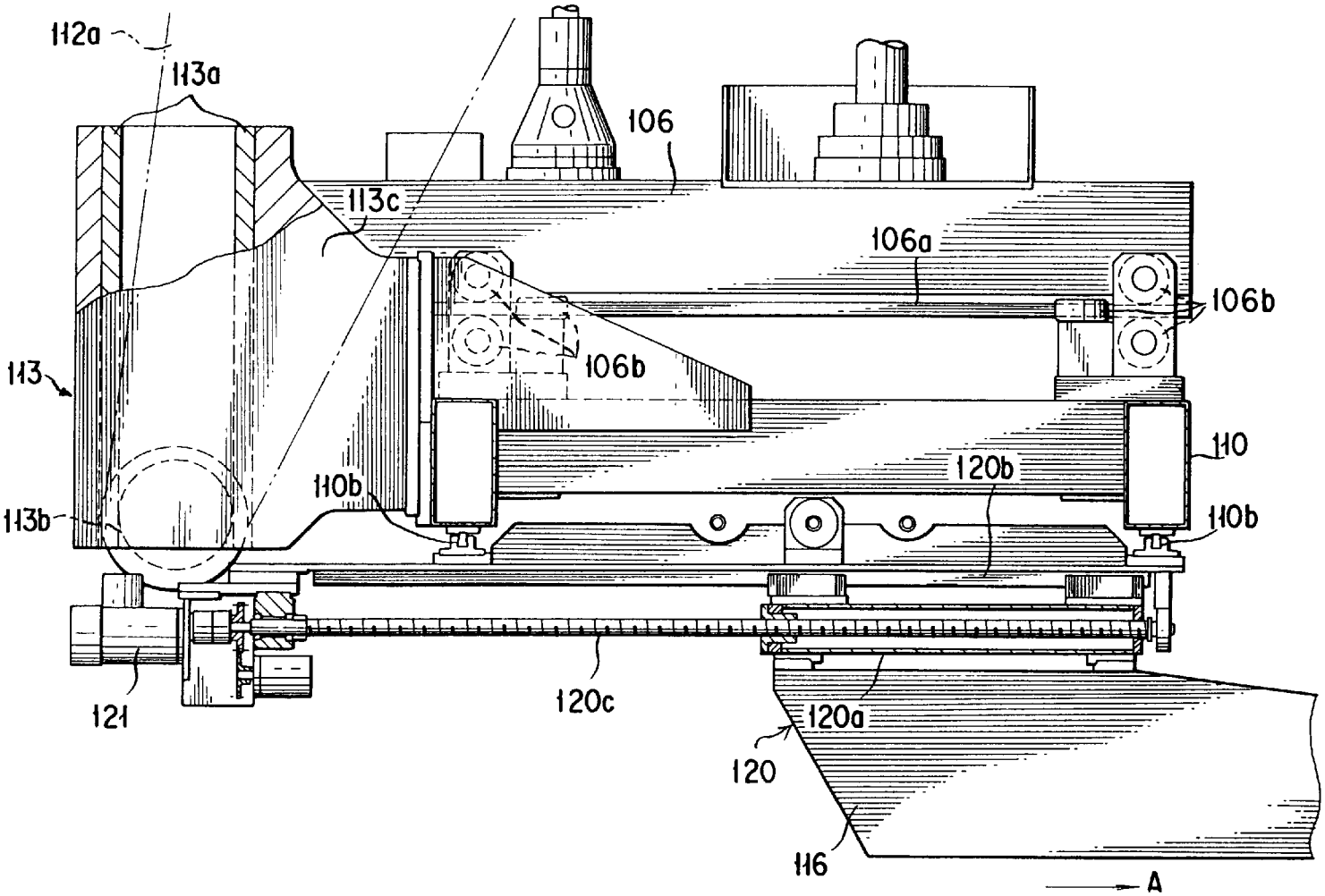
FIG. 16 is an enlarged illustration showing a slider mechanism of the foregoing work carrying-in apparatus.

As shown in FIG. 16, the carrier 110 has a plurality of guide rollers 106*b* clamping the guide rail 106*a* provided on the lifting beam 106, in a vertical direction and in left and right directions to prevent movement in the feeding direction along the guide rail 106*a*. Then, on the upstream side end portions and so forth (can be center portion) on the carrier 110, a slider mechanism 113 connecting the carrier 110 and the rocking lever 112*a* are mounted.

The foregoing rocking lever 112*a* is provided in the driving portion 112 as shown in FIG. 8, and the upper end thereof is supported on the cam box 11 by the support shaft 112*b*.

In the vicinity of the upper end side of the foregoing rocking lever 112*a*, the cam shaft 16 is rotatably driven by the driving power taken from the transfer press body 1. Two positive cams 112*e* and 112*f* are provided on cam shaft 16.

On the peripheries of these cams 112*e* and 112*f*, two cam followers 112*i* and 112*i*, which are provided in the upper portion of the rocking lever 112*a*, are contacted so that the lower end side of the rocking lever 112*a* is rocked in the feeding direction A around the support shaft 112*b* by the positive cams 112*e* and 112*f* in accordance with the rotation of the cam shaft 16.

On the lower end of the rocking lever 112*a*, a roller 113*b* rolling between the guide rails 113*a* of the slider mechanism 113 is rotatably supported.

As shown in FIG. 16, the slider mechanism 113 has a guide member 113*c* fixed to the upstream side end portion (can be the center portion) of the carrier 110. A pair of guide rails 113*a* are provided on the guide member 113*c* in a vertically spaced relationship. The roller 113*b* rolls in the vertical direction between these guide rails 113*a* so as to convert the rocking motion of the rocking lever 112*a* into reciprocal motion of the carrier 110.

On the lower portion of the carrier 110, a pair of guide rails 110*b* are provided in a direction perpendicular to the feeding direction and in a spaced apart relationship in the feeding direction A. On these guide rails 110*b*, a width direction adjusting means 115 is provided.

Figure 17:
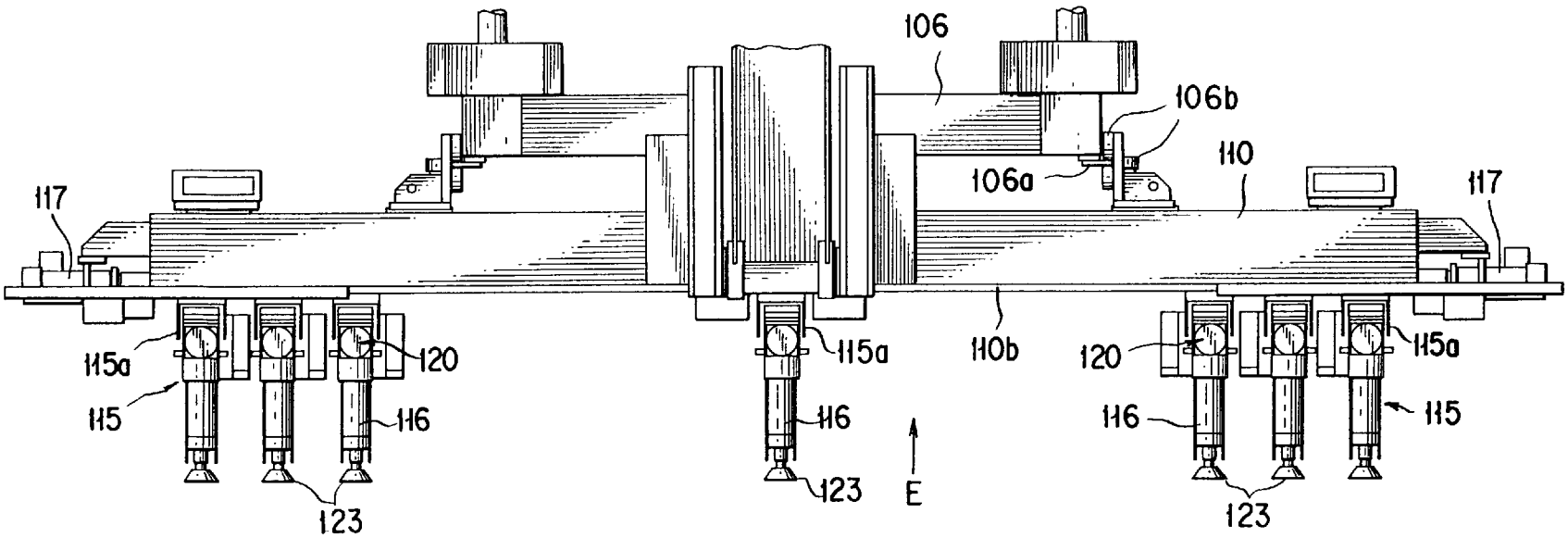
FIG. 17 is a front elevational view showing a width adjusting means of the foregoing work carrying-in apparatus.
Figure 18:
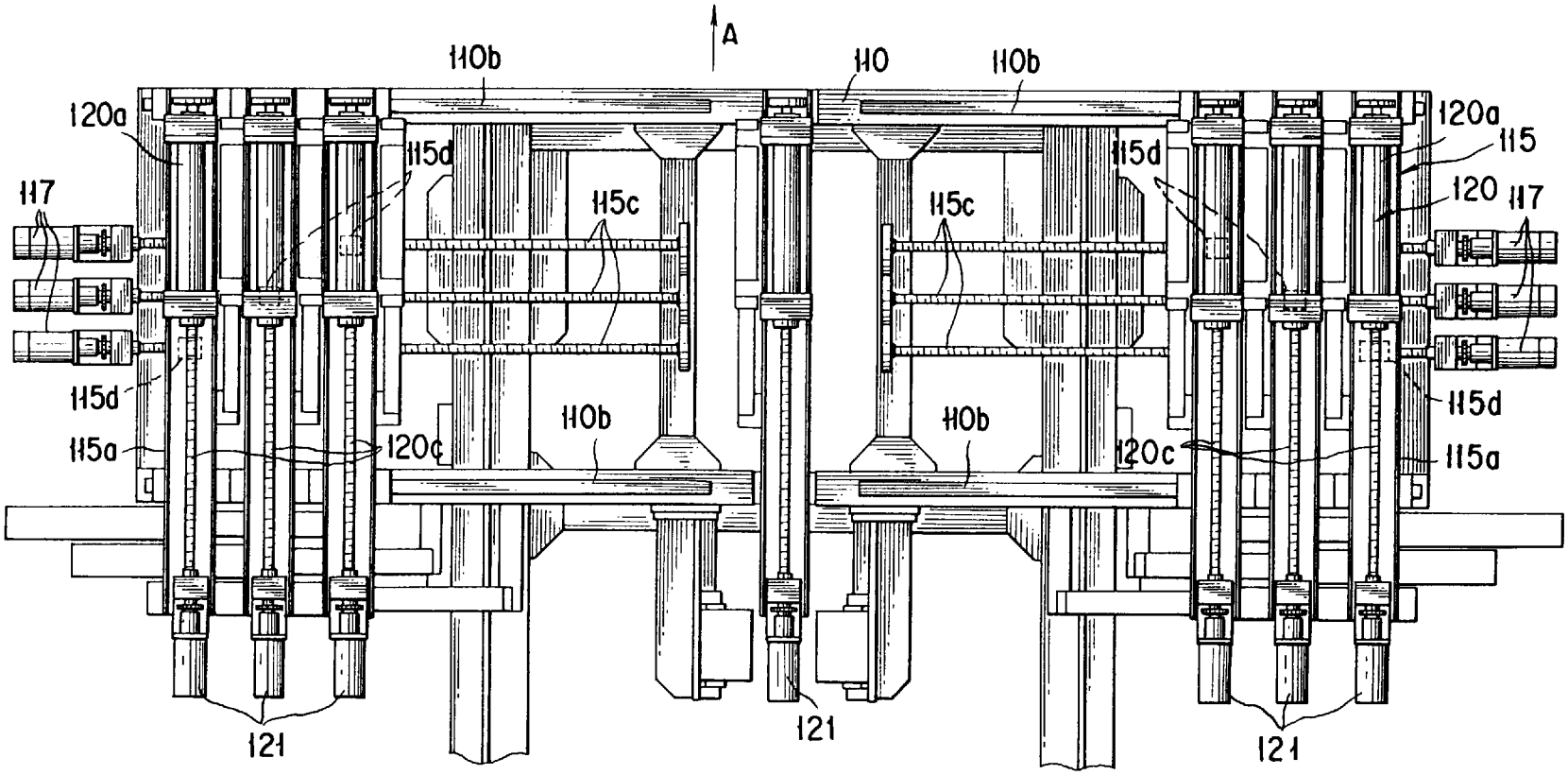
FIG. 18 is an illustration of the width adjusting means as viewed in a direction of arrow E of FIG. 17.
Figure 19:
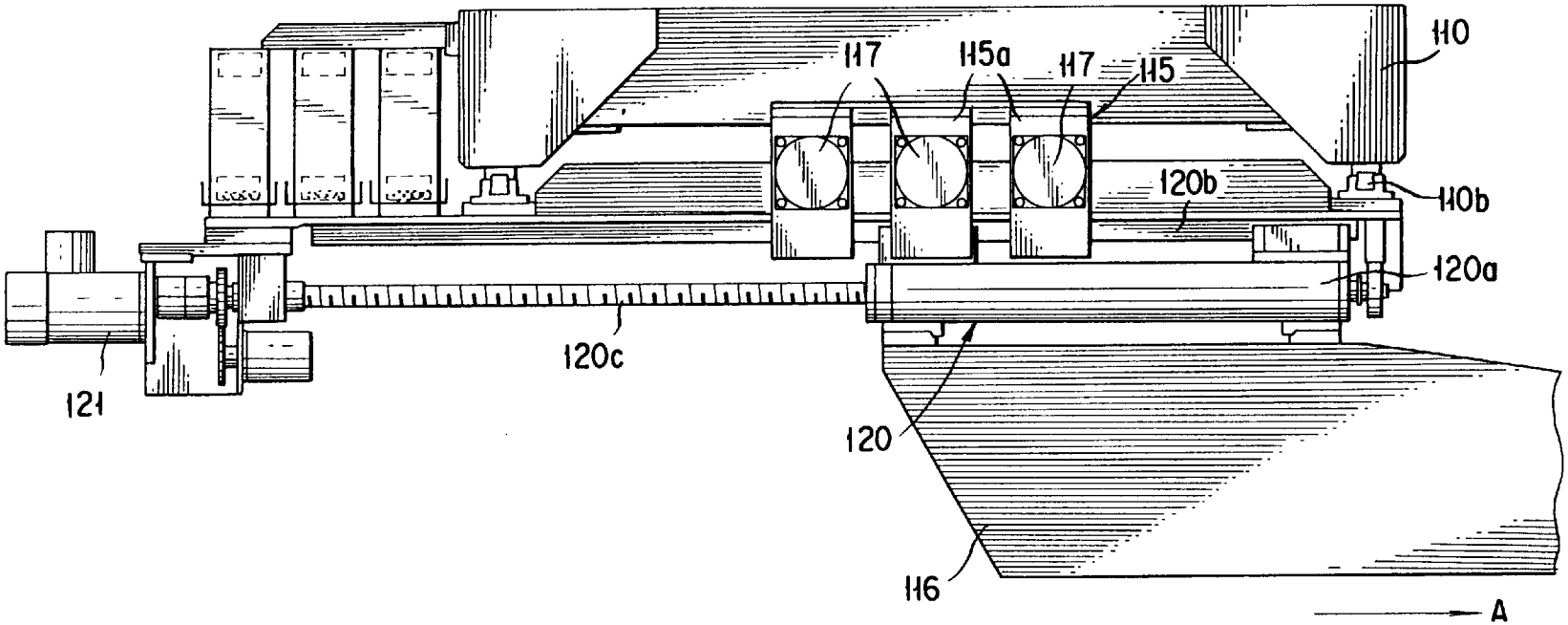
FIG. 19 is a front elevational view of a feeding direction adjusting means of the foregoing work carrying-in apparatus.

The width direction adjusting means 115 is adapted for adjusting an interval between the work supporting arms 116 depending upon the width of the work 5. As shown in FIGS. 17 and 18, a plurality of, e.g. seven, width adjusting members 115*a* are provided.

The central width adjusting member 115*a* is fixed to the carrier 110. The intervals between respective three central width adjusting members 115*a*, which are provided on both sides of the width adjusting member 115*a*, can be adjusted by the width adjusting motor 117 provided at each of the width adjusting members 115*a*.

Three adjusting motors 117 are mounted on both sides of the carrier 110, respectively, and are connected to a width feeding threaded shaft 115*c* which is a ball threaded shaft disposed in a direction perpendicular to the respective width adjusting member 115 (direction parallel to the guide rail 110*b*).

Each width feeding threaded shaft 115*c* is threadingly engaged with nut member 115*d* provided in each width adjusting member 115*a*. By simultaneously or individually rotating the width feeding threaded shaft 115*c* by each adjusting motor 117, the interval between respective width adjusting members 115*a* can be freely adjusted.

On the lower surface of the foregoing respective width adjusting member 115*a*, a feed direction adjusting means 120 is provided.

The feeding direction adjusting means 120 has a feeding adjusting member 120*a* which is movably supported on guide rail 120*b* provided on the bottom surface of the respective width adjusting member 115*a*, for movement in the feeding direction A.

Each of the foregoing feed adjusting members 120*a* is threadingly engaged with a threaded feed shaft 120*c* which consists of a ball threaded shaft disposed in the longitudinal direction of the respective adjusting member 115*a*. In conjunction therewith, one end side of each threaded feed shaft 120*c* is connected to a feeding direction adjusting motor 121 provided on the upstream side of respective width adjusting member 115*a*. Accordingly, by simultaneously or individually rotating the threaded feed shafts 120*c* by means of these feeding direction adjusting motors 121, the respective feed adjusting member 120*a* can be freely shifted for adjustment in the feeding direction A.

The base end portion of the work supporting arm 116 is secured on the lower surface of the feeding adjusting member 120*a*.

The tip end side of respective work supporting arm 116 projects toward the transfer press body 1 at an angle so that the tip end thereof is sequentially lowered. A plurality of the work suction means 123, such as a vacuum cap, are mounted on the lower surface of the tip end side of the work supporting arms 116.

Next, a discussion will be given regarding the operation of the work carrying-in apparatus constructed as set forth above.

Figure 21:
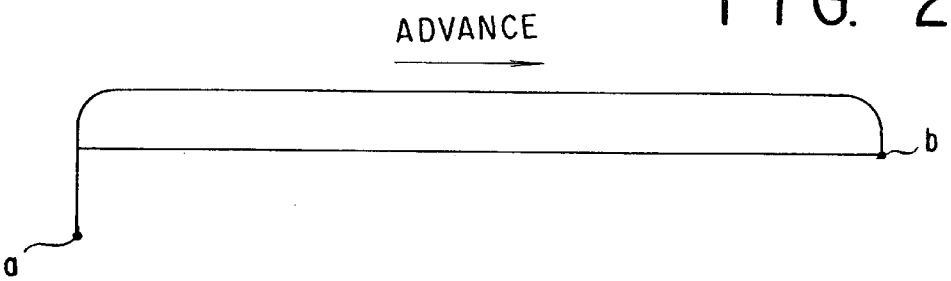
FIG. 21 is a diagrammatic illustration showing a motion curve of the foregoing work carrying-in apparatus.
Figure 20:
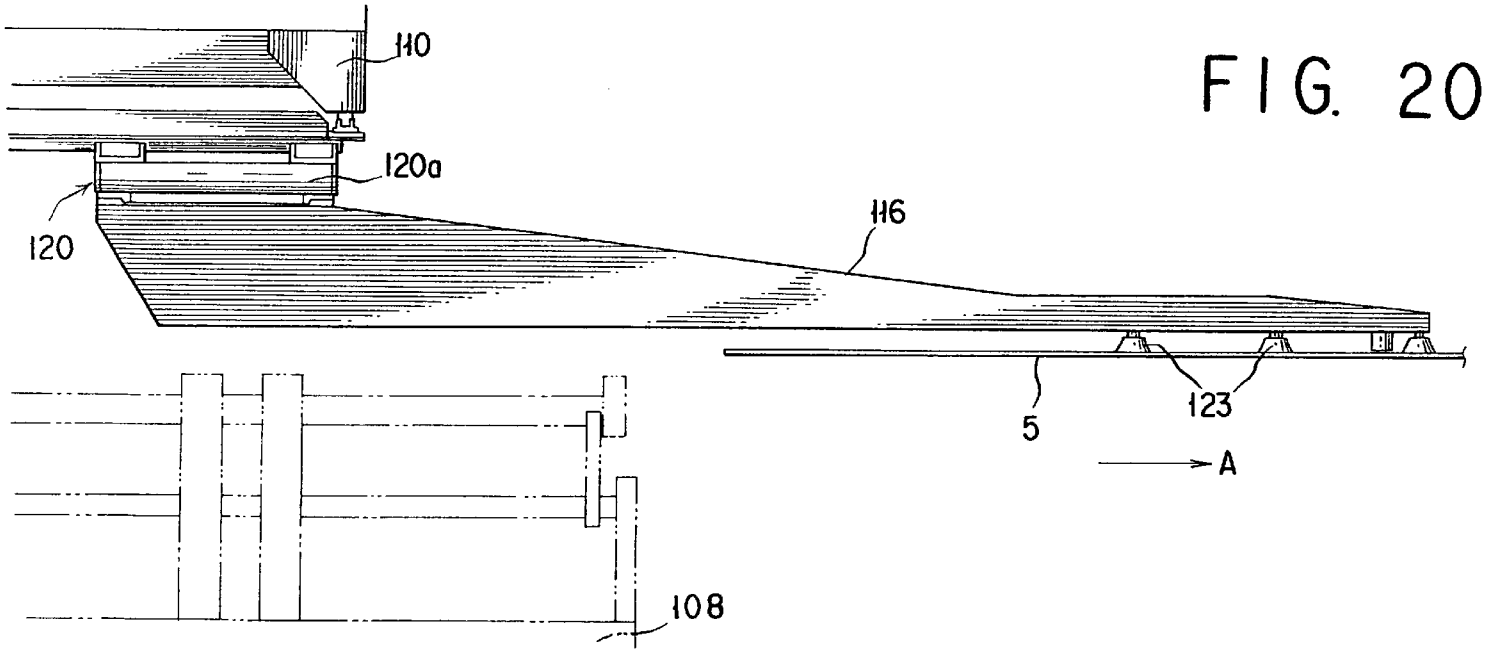
FIG. 20 is an enlarged view showing a work supporting arm of the foregoing work carrying-in apparatus.

Now, when the works 5, separated one-by-one by the destacker 6, are fed into the centering apparatus 8, the carrier 110, which is placed in the stand-by state above the centering apparatus 8, is lowered together with the lifting beam 106 by the lifting means 105. Then, the work suction means 123 provided on the tip end of the work supporting arm 110 sucks the work, centering of which is completed, from above at a point a in the motion curve shown in FIG. 21.

Once suction of the work 5 is completed, the lifting beam 106 is elevated by the lifting means 105. When the work 5 reaches a position in the vicinity of the path line, the rocking lever 112*a* starts to rock about the support shaft 112*b* due to the positive cams 112*e* and 112*f*. By this, the carrier 110 is shifted in the feeding direction A along the lifting beam 106. Thus, the work 5, which has been sucked by the work suction means 123, starts to be transported along the motion curve shown in FIG. 21.

Then, when the work 5 reaches a position in the vicinity of the first processing station $W_1$, the lifting beam 106 is lowered by the lifting means 105. At this time, since the advancing operation is finished once above the first processing station $W_1$, the work 5 is fed into the first processing station $W_1$ from above and released from the work suction means 123 at point b in the motion curve shown in FIG. 21.

Thereafter, since the rocking lever 112*a* is pivoted in the opposite direction to that upon advancing, the carrier 110 is returned to the initial position and is placed in stand-by state for the next transporting operation.

The following is the operation upon carrying-in of the work. It should be appreciated that the path line may be varied depending upon the size of the work to be processed, die or so forth.

In the work carrying-in apparatus according to the present invention, since the servo motor is used in the lifting means 105, it can be easily adapted simply by correcting a command value for controlling the servo motor even when the path line is varied.

Figure 1:
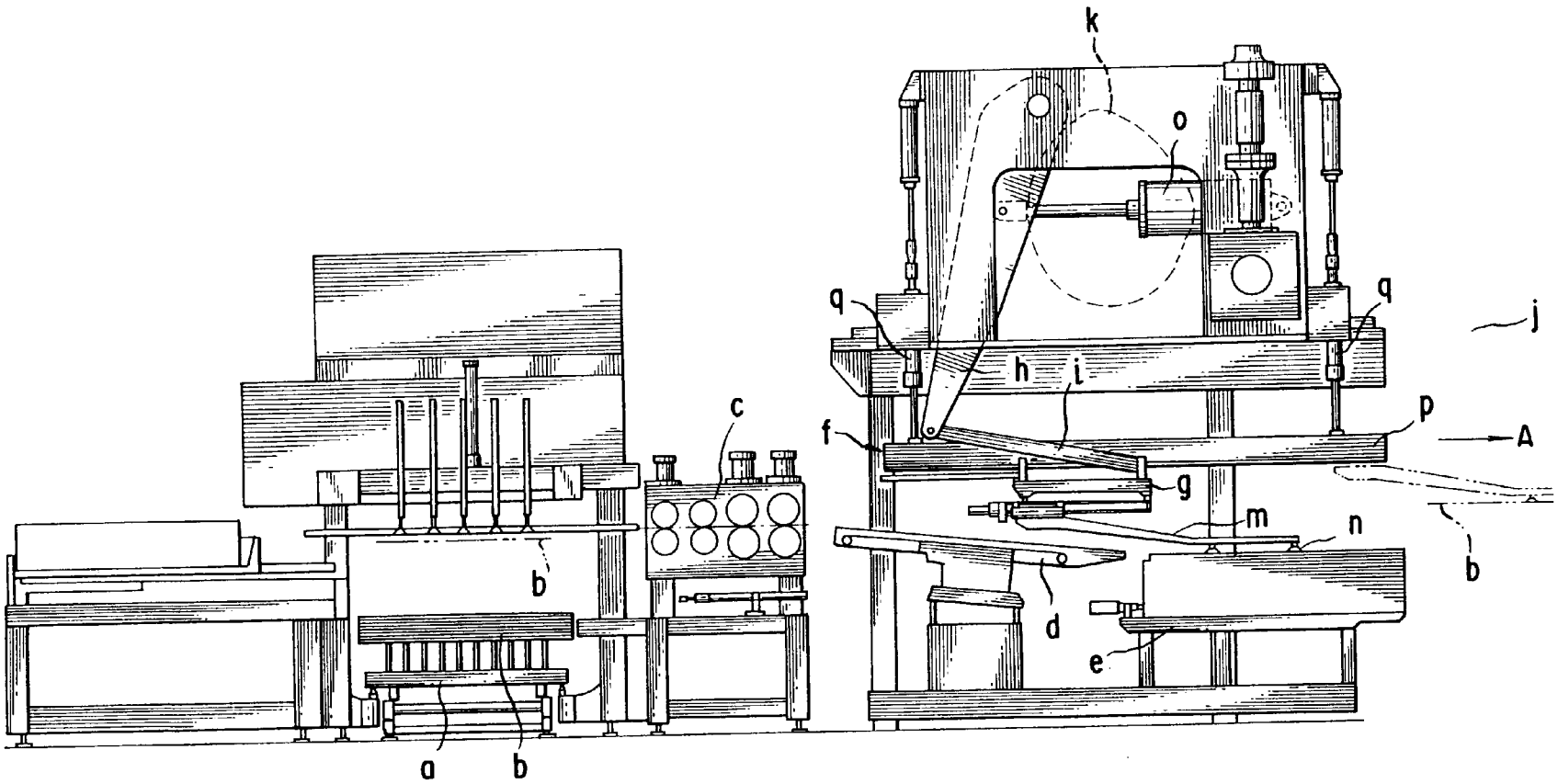
FIG. 1 is an explanatory illustration showing a conventional work carrying-in apparatus of a transfer press.
Figure 2:
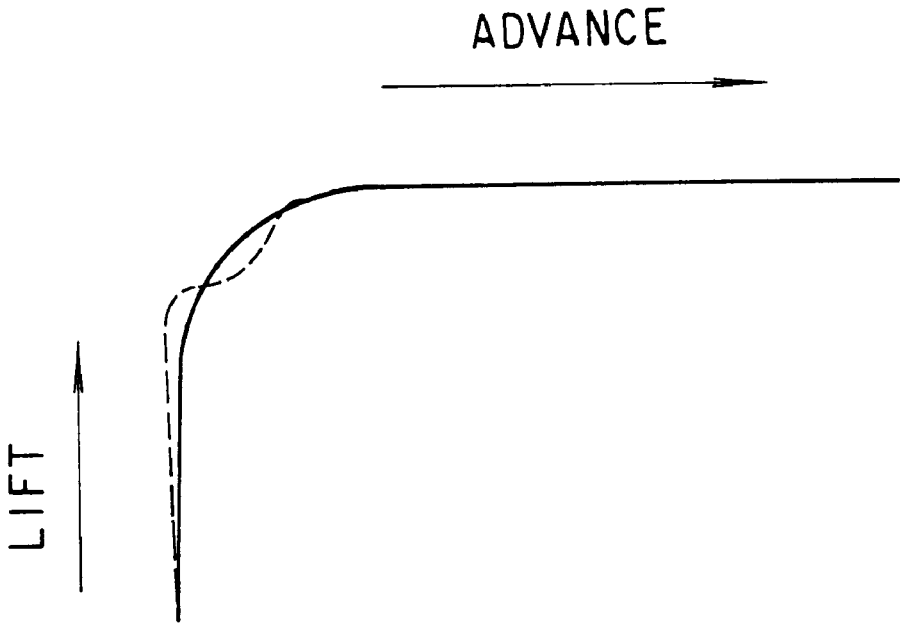
FIG. 2 is an explanatory illustration showing an operation of the conventional work carrying-in apparatus of a transfer press.

By using the servo motor in the lifting means 105, the lifting stroke or the lifting timing can be arbitrarily set. Also, by employing the slider mechanism 113 in the connecting portion between the rocking lever 112*a* and the carrier 110, the variation of the positional relationship between the rocking lever 112*a* and the carrier 110 in the feeding direction is not caused even when the lifting stroke or the pass line is varied. Accordingly, when the work suction means 123 is transited from the lifting operation to the feeding operation, the motion curve becomes one as shown by a solid line in FIG. 2 so as to not cause the swing motion in the forward direction as shown by the broken line as in the prior art. Therefore, drop down of the work from the work suction means 123 which can cause mis-feeding are avoided.

On the other hand, it is necessary to vary the sucking position of the work depending on the size of the work to be fed in or the work in which holes or so forth are made by preliminary processing.

In the prior art, an operation of modifying the position or interval of the work supporting arm 116 by the worker during the internal initial setup is necessary. However, in the work carrying-in apparatus according to the present invention, these operation can be performed automatically.

When the interval of the support arm 116 to be used depending upon the size of the work 5 is varied or number of the supporting arms 116 to be used is varied, by rotating the threaded shaft 115*c* by the width adjusting motor 117 of the width direction adjusting means 115, each width adjusting member 115*a* is shifted in the direction perpendicular to the feeding direction A to set the interval of respective support arms 116 and to shift the support 116 which are not to be used, to the stand-by position at both sides.

On the other hand, when the work suction means 123 is moved in the feeding direction in order to suck the work 5 at the position in the vicinity of the center of gravity thereof, by rotating the threaded feed shaft 120*c* by the feeding direction adjusting motor 121 of the feeding direction adjusting means 120, the work supporting arm 116 is shifted in the feeding direction A to perform the adjustment.

Also, when the work 5 cannot be sucked at the position in the vicinity of the center of gravity due to a preliminarily formed hole or so forth in the vicinity of the gravity center of the work 5, the work supporting arms 116 can be individually shifted for adjustment by the width direction adjusting means 115 and the feeding direction adjusting means 120 to make it possible to feed the work 5, which is formed with a hole in the vicinity of its center of gravity, into the first processing station $W_1$ of the transfer press body by sucking the same in a stable attitude.

Although the invention has been illustrated and described with respect to exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodied within a scope encompassed and equivalents thereof with respect to the feature set out in the appended claims.

We claim:

1. A transfer press comprising:

a press body;

a work delivery apparatus for feeding a work into said press body;

a series of processing stations located in said press body;

a transfer feeder, provided in said press body, for sequentially transporting works in a feed direction to said processing stations;

a slider driving mechanism for driving a slider, said slider driving mechanism being disposed in said press body;

a cam shaft provided at an upper upstream portion of said press body, said cam shaft being rotatable by driving power taken from said slide driving mechanism;

a loader cam and a feeding cam mounted on said cam shaft; and a rocking lever and a feeding lever pivotably mounted at an upper upstream portion of said press body, wherein said loader cam and said rocking lever define a driving mechanism for said work delivery apparatus, and said feeding cam and said feeding lever define a driving mechanism for said transfer feeder, wherein said work delivery apparatus is driven in a feeding direction by rocking said rocking lever by movement of said loader cam, and said transfer feeder is driven in the feeding direction by rocking said feeding lever by movement of said feeding cam.

2. A transfer press as claimed in claim 1, wherein said cam shaft is oriented along a direction which perpendicularly intersects the feed direction.

3. A transfer press as claimed in claim 1, further comprising a clutch means disposed between said slider driving mechanism and said cam shaft.

4. A transfer press apparatus as claimed in claim 1, wherein said loader cam is a positive cam, and said feeding cam is a positive cam.

5. A transfer press apparatus as claimed in claim 1, further comprising a slider mechanism disposed between a lower end of said rocking lever and said carrier for converting rocking movement of said rocking lever into reciprocal motion of said carrier.

6. A work delivery apparatus for feeding a work into an upstream side of a press body of a transfer press, said work delivery apparatus comprising:

a cam shaft;

a loader positive cam mounted on said cam shaft;

a rocking lever adapted to be pivotably mounted at an upper upstream portion of the press body, said rocking lever being rocked by said loader cam;

a lifting means;

a lifting beam supported by said lifting means so as to be movable in a vertical direction;

a carrier reciprocally movable along said lifting means in a feeding direction;

a slider mechanism disposed between a lower end of said rocking lever and said carrier for converting rocking movement of said rocking lever into reciprocal motion of said carrier;

a plurality of work supporting arms, each of said work supporting arms having a tip end portion and a base end portion supported on said carrier; and work suction means provided on each of said tip end portions of said work supporting arms.

7. A work delivery apparatus as claimed in claim 6, further comprising a servo motor for providing a driving source for said lifting means.

8. A work delivery apparatus as claimed in claim 6, further comprising width direction adjusting means for adjusting said work supporting arms along a direction which is perpendicular to the feeding direction.

9. A work delivery apparatus as claimed in claim 6, further comprising feeding direction adjusting means for adjusting the position of said work supporting arms along the feeding direction.

* * * * *